US011124880B2

(12) United States Patent
Dahlenburg et al.

(10) Patent No.: US 11,124,880 B2
(45) **Date of Patent: *Sep. 21, 2021**

(54) METHOD FOR NICKEL-FREE PHOSPHATING METAL SURFACES

(71) Applicant: Chemetall GMBH, Frankfurt (DE)

(72) Inventors: Olaf Dahlenburg, Frankfurt am Main (DE); Lisa Schmeier, Frankfurt am Main (DE)

(73) Assignee: Chemetall GmbH, Frankfurt (DE)

( * ) Notice: Subject to any disclaimer, the term of this patent is extended or adjusted under 35 U.S.C. 154(b) by 74 days.

This patent is subject to a terminal disclaimer.

(21) Appl. No.: 16/091,294

(22) PCT Filed: Jan. 18, 2017

(86) PCT No.: PCT/EP2017/050993
§ 371 (c)(1),
(2) Date: Oct. 4, 2018

(87) PCT Pub. No.: WO2017/174222
PCT Pub. Date: Oct. 12, 2017

(65) Prior Publication Data

US 2019/0127854 A1 May 2, 2019

(30) Foreign Application Priority Data

Apr. 7, 2016 (DE) ..... 102016205815

(51) Int. Cl.

| | |
|---|---|
| ***C23C 22/00*** | (2006.01) |
| ***C23C 22/18*** | (2006.01) |
| ***C23C 22/36*** | (2006.01) |
| ***C25D 13/20*** | (2006.01) |
| ***C23C 22/78*** | (2006.01) |
| ***C23C 22/82*** | (2006.01) |
| ***C25D 5/48*** | (2006.01) |

(52) U.S. Cl.
CPC ..... *C23C 22/182* (2013.01); *C23C 22/362* (2013.01); *C23C 22/364* (2013.01); *C23C 22/365* (2013.01); *C23C 22/78* (2013.01); *C23C 22/82* (2013.01); *C25D 5/48* (2013.01); *C25D 13/20* (2013.01)

(58) Field of Classification Search
CPC ... C23C 22/182; C23C 22/365; C23C 22/362; C23C 22/78; C23C 22/82; C23C 22/364; C25D 13/20; C25D 5/48
See application file for complete search history.

(56) References Cited

U.S. PATENT DOCUMENTS

| | | | | |
|---|---|---|---|---|
| 5,891,269 | A * | 4/1999 | Koerner | C25D 11/246 148/272 |
| 7,208,053 | B2 * | 4/2007 | Wietzoreck | C23C 22/184 148/253 |
| 2008/0314479 | A1 | 12/2008 | Cape | |
| 2018/0112313 | A1 | 4/2018 | Dahlenburg et al. | |
| 2018/0334748 | A9 | 4/2018 | Dahlenburg et al. | |

FOREIGN PATENT DOCUMENTS

| | | | |
|---|---|---|---|
| BY | 6260 | C1 | 6/2004 |
| DE | 19511573 | A1 | 10/1996 |
| EP | 0370535 | A1 | 5/1990 |
| JP | H08134661 | A | 5/1996 |
| RU | 2560891 | C1 | 8/2015 |

OTHER PUBLICATIONS

International Search Report for International Patent Application No. PCT/EP2017/050993, dated Oct. 4, 2017, 2 pages.
W. Rausch, "Chapter 8—Analytical Control of Process Chemicals", Eugen G. Leuze Verlag, 2005, 3rd edition, 17 pages.

* cited by examiner

*Primary Examiner* — Hai Y Zhang
(74) *Attorney, Agent, or Firm* — Armstrong Teasdale LLP

(57) ABSTRACT

Described herein is a method for phosphating of a metallic surface, wherein a metallic surface, optionally after cleaning and/or activation, is first treated with an acidic, aqueous, substantially nickel-free phosphating composition that includes zinc ions, manganese ions, iron(III) ions and phosphate ions, and is thereafter optionally rinsed and/or dried. Also described herein are a corresponding phosphating composition and a correspondingly phosphate-coated metallic surface.

17 Claims, 9 Drawing Sheets

METHOD FOR NICKEL-FREE PHOSPHATING METAL SURFACES

CROSS-REFERENCE TO RELATED APPLICATIONS

This application is a U.S. National Phase Application of International Patent Application No. PCT/EP2017/050993, filed Jan. 18, 2017, which claims the benefit of priority to German Patent Application No. 10 2016 205 815.0, filed Apr. 7, 2016, the entire contents of which are hereby incorporated by reference herein.

FIELD OF THE INVENTION

The present invention relates to an improved method for substantially nickel-free phosphating of a metallic surface, to a corresponding phosphating composition, and also to a correspondingly phosphate-coated metallic surface.

BACKGROUND

Phosphate coatings on metallic surfaces are known from the prior art. Such coatings serve to prevent corrosion of the metallic surfaces and also, furthermore, as adhesion promoters for subsequent coating films.

Such phosphate coatings are employed in particular in the areas of the automobile industry and also of general industry.

The subsequent coating films, as well as powder coatings and wet paints, are, in particular, cathodically deposited electrocoat materials (CEC). Since the deposition of CEC requires a flow of current between metallic surface and treatment bath, it is important to set a defined electrical conductivity in the phosphate coating in order to ensure efficient and uniform deposition.

Phosphate coatings, therefore, are customarily applied using a nickel-containing phosphating solution. The nickel deposited in this process, elementally or as an alloy constituent, e.g., Zn/Ni, provides appropriate conductivity of the coating in the course of the subsequent electrocoating.

On account of their high toxicity and environmental harmfulness, however, nickel ions are no longer a desirable constituent of treatment solutions, and ought therefore as far as possible be avoided or at least reduced in terms of their amount.

The use of nickel-free or low-nickel phosphating solutions is indeed known in principle. It is limited, however, to particular substrates such as steel.

The stated nickel-free or low-nickel systems, moreover, may result in poor corrosion values and coating adhesion values under prevailing CEC deposition conditions, owing to a nonideal substrate surface.

A further problem with nickel-free phosphating baths is to assure adequate stability of the respective bath with respect to changes in parameters or the throughput of metallic substrates:

The bath is at first free of sludge or any turbidity. However, it becomes turbid after the first throughput of metal sheets, and large amounts of sludge are ultimately formed. The parameters are unstable.

SUMMARY

It was an object of the present invention, therefore, to provide a method with which metallic surfaces can be subjected to substantially nickel-free phosphating, with the aforementioned disadvantages of the prior art being avoided, and more particularly a higher bath stability being obtained.

This object is achieved by a method according to claim 1, a phosphating composition according to claim 13, and a phosphate-coated metallic surface according to claim 15.

In the method of the invention for phosphating of a metallic surface, a metallic surface, optionally after cleaning and/or activation, is treated with an acidic, aqueous, substantially nickel-free phosphating composition which comprises zinc ions, manganese ions, iron(III) ions and phosphate ions, and is thereafter optionally rinsed and/or dried.

DETAILED DESCRIPTION

Figure 1:
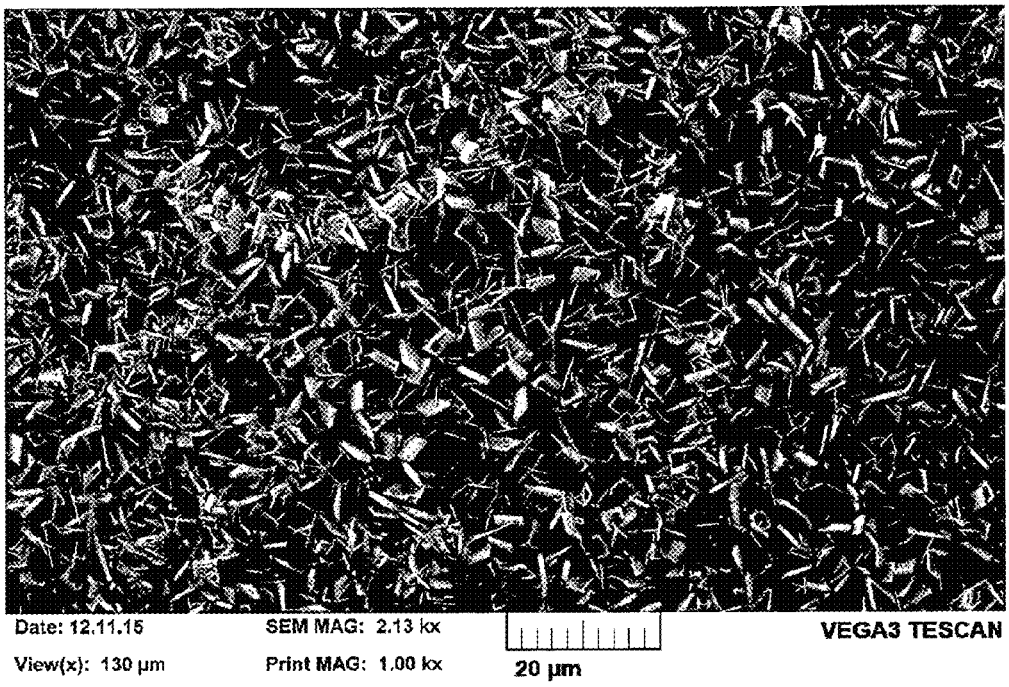
FIG. 1 depicts a scanning electron micrograph of an exemplary phosphate layer prepared on a hot dip galvanized steel test plate according to a first comparative example.

Definitions:

The method of the invention can be used to treat either an uncoated metallic surface or else a metallic surface which has already been conversion coated. Reference below to a "metallic surface" is therefore always to be taken as also including an already conversion-coated metallic surface.

An "aqueous composition" for the purposes of the present invention is a composition which comprises at least partly, preferably predominantly water as its solvent. In addition to dissolved constituents, it may also comprise dispersed—i.e., emulsified and/or suspended—constituents.

"Substantially nickel-free" in the present case means that less than 0.3 g/l of nickel ions are present.

For the purposes of the present invention, "phosphate ions" also refers to hydrogenphosphate, dihydrogenphosphate and phosphoric acid. Moreover, the intention is to encompass pyrophosphoric acid and polyphosphoric acid and all of their partially and fully deprotonated forms.

A "metal ion" for the purposes of the present invention is alternatively a metal cation, a complex metal cation, or a complex metal anion.

The metallic surface preferably comprises steel, a hot-dip galvanized system, an electrolytically galvanized system, aluminum, or alloys thereof such as Zn/Fe or Zn/Mg, for example. In the case of the hot-dip galvanized systems and electrolytically galvanized systems, they are in each case more particularly a system of this kind on steel. The metallic surface more particularly is at least partially galvanized.

The method of the invention is especially suitable for multimetal applications.

If a metallic surface is to be coated and does not represent a fresh hot-dip galvanized system, it is advantageous, prior to the treatment with the phosphating composition, for the metallic surface first to be cleaned, and more particularly degreased, in an aqueous cleaning composition. For this purpose, in particular, an acidic, neutral, alkaline or strongly alkaline cleaning composition may be used, but optionally also, additionally, an acidic or neutral pickling composition.

An alkaline or strongly alkaline cleaning composition has proven especially advantageous here.

Besides at least one surfactant, the aqueous cleaning composition may optionally also comprise a cleaning-agent builder and/or other additions such as complexing agents. Also possible is the use of an activating cleaner.

After the cleaning/pickling, there is advantageously at least one rinsing of the metallic surface with water, in which case an additive in solution in water, such as a nitrite or surfactant, for example, may optionally also be added to the water.

Prior to the treatment of the metallic surface with the phosphating composition, it is advantageous to treat the metallic surface with an activating composition. The purpose of the activating composition is to deposit a multiplicity of ultrafine phosphate particles as seed crystals on the metallic surface. These crystals help to form a phosphate layer, more particularly a crystalline phosphate layer, having an extremely high number of densely disposed, fine phosphate crystals, or a largely impervious phosphate layer, in the subsequent method step, in contact with the phosphating composition—preferably without rinsing in-between.

Activating compositions contemplated include, in particular, acidic or alkaline compositions based on titanium phosphate or zinc phosphate.

It may, however, also be advantageous to add activating agents, especially titanium phosphate or zinc phosphate, to the cleaning composition—in other words, to carry out cleaning and activation in one step.

The acidic, aqueous, substantially nickel-free phosphating composition comprises zinc ions, manganese ions, iron(III) ions and phosphate ions.

The content of iron(III) ions achieves adequate stability of the phosphating composition with respect to changes in parameters or the throughput of metallic substrates.

The content of iron(III) ions in the phosphating composition is preferably in the range from 1 to 200 mg/l, more preferably from 1 to 100 mg/l, more preferably from 5 to 100 mg/l, especially preferably from 5 to 50 mg/l and very preferably from 5 to 20 mg/l.

The iron(III) ions can be added to the phosphating composition, for example, in the form of nitrate, sulfate, citrate or tartrate.

However, the iron(III) ions are preferably not added in the form of nitrate, since too much nitrate has an adverse effect on the layer composition: the manganese content of the layer formed is lower.

It is particularly advantageous when the iron(III) ions are added to the phosphating composition prior to the establishment of the Free acid (FA; cf. the remarks further down), which is attributable to the fact that this reduces the precipitation of zinc salts and hence the bath stability is increased.

The phosphating composition here may be obtained from a concentrate by dilution with a suitable solvent, preferably with water, by a factor of between 1 and 100, preferably between 5 and 50, and, where necessary, addition of a pH-modifying substance.

The phosphating composition preferably comprises the following components in the following preferred and more preferred concentration ranges:

| | | |
|---|---|---|
| Zn | 0.3 to 3.0 g/l | 0.5 to 2.0 g/l |
| Mn | 0.3 to 2.0 g/l | 0.5 to 1.5 g/l |
| Fe(III) | 1 to 200 mg/l | 1 to 100 mg/l |
| Phosphate (calculated as $P_2O_5$) | 8 to 25 g/l | 10 to 18 g/l |
| Free fluoride | 30 to 250 mg/l | 50 to 180 mg/l |
| Complex fluoride (calculated, e.g., as $SiF_6^{2-}$ and/or $BE_4^-$) | 0 to 5 g/l | 0.5 to 3 g/l |

With regard to the manganese ions, however, a concentration in the range from 0.3 to 2.5 g/l has already proven advantageous, and in terms of the free fluoride, a concentration in the range from 10 to 250 mg/l.

The complex fluoride preferably comprises tetrafluoroborate ($BF_4^-$) and/or hexafluorosilicate ($SiF_6^{2-}$).

Particularly in the treatment of aluminum and/or galvanized material, the presence in the phosphating composition of complex fluoride and also simple fluoride, sodium fluoride for example, is an advantage.

$Al^{3+}$ in phosphating systems is a bath poison and may be removed from the system by complexing with fluoride, in the form of cryolite, for example. Complex fluorides are added to the bath as "fluoride buffers", since otherwise the fluoride content would rapidly drop and coating would no longer take place. Fluoride, then, supports the formation of the phosphate layer and consequently leads indirectly to an improvement in coating adhesion and also corrosion control, as well. On galvanized material, furthermore, complex fluoride helps to prevent defects such as specks.

The phosphating composition further preferably comprises at least one accelerator selected from the group consisting of the following compounds in the following preferred and more preferred concentration ranges:

| | | |
|---|---|---|
| Nitroguanidine | 0.2 to 3.0 g/l | 0.2 to 1.55 g/l |
| $H_2O_2$ | 10 to 100 mg/l | 15 to 50 mg/l |
| Nitroguanidine/ $H_2O_2$ | 0.2 to 2.0 g/l/10 to 50 mg/l | 0.2 to 1.5 g/l/15 to 30 mg/l |
| Nitrite | 30 to 300 mg/l | 90 to 150 mg/l |
| Hydroxylamine | 0.1 to 5 g/l | 0.4 to 3 g/l |

With regard to the nitroguanidine, however, a concentration in the range from 0.1 to 3.0 g/l has already proven advantageous, with regard to the $H_2O_2$ a concentration in the range from 5 to 200 mg/l.

Very preferably the at least one accelerator is $H_2O_2$.

The phosphating composition preferably contains less than 1 g/l, more preferably less than 0.5 g/l, very preferably less than 0.1 g/l and especially preferably less than 0.05 to 0.1 g/l of nitrate.

The reason for this is that in the case of a galvanized surface, in particular, the nitrate in the phosphating composition causes an additional acceleration in the layer-forming reaction, resulting in lower coat weights, but in particular reduces the incorporation of the manganese into the crystal.

If the manganese content of the phosphate coating is too low, however, its alkali resistance suffers.

The alkali resistance in turn plays a critical part in the event of subsequent cathodic electrocoat deposition. In this process, electrolytic dissociation of water occurs at the substrate surface: hydroxide ions are formed. As a result, the pH at the substrate interface goes up. It is indeed only by this means that the electrocoat material is able to agglomerate and be deposited. However, the elevated pH may also damage the crystalline phosphate layer.

The phosphating composition preferably has a temperature in the range from 30 to 55° C.

The phosphating composition may be characterized, furthermore, by the following preferred and more preferred parameter ranges:

| | | |
|---|---|---|
| FA | 0.3 to 2.0 | 0.7 to 1.6 |
| FA (dil.) | 0.5 to 8 | 1 to 6 |
| TAF | 12 to 28 | 22 to 26 |
| TA | 12 to 45 | 18 to 35 |
| A value | 0.01 to 0.2 | 0.03 to 0.15 |
| Temperature ° C. | 30 to 50° C. | 35 to 45° C. |

With regard to the FA parameter, however, a value in the range from 0.2 to 2.5 has already proven advantageous, and with regard to the temperature a value in the range from 30 to 55° C.

In this listing, "FA" stands for Free acid, "FA (dil.)" stands for Free acid (diluted), "TAF" stands for Total acid, Fischer, "TA" stands for Total acid, and "A value" stands for Acid value.

These parameters are determined here as follows:

Free Acid (FA):

For determination of the free acid, 10 ml of the phosphating composition are pipetted into a suitable vessel, such as a 300 ml Erlenmeyer flask. If the phosphating composition contains complex fluorides, an additional 2-3 g of potassium chloride (KCl) are added to the sample. Titration then takes place, using a pH meter and an electrode, with 0.1 M NaOH to a pH of 3.6. The quantity of 0.1 M NaOH consumed in this titration, in ml per 10 ml of the phosphating composition, gives the value of the Free acid (FA) in points.

Free Acid (Diluted) (FA (dil.)):

For determination of the free acid (diluted), 10 ml of the phosphating composition are pipetted into a suitable vessel, such as a 300 ml Erlenmeyer flask. Subsequently 150 ml of DI water are added. Titration takes place, using a pH meter and an electrode, with 0.1 M NaOH to a pH of 4.7. The quantity of 0.1 M NaOH consumed in this titration, in ml per 10 ml of the dilute phosphating composition, gives the value of the Free acid (diluted) (FA (dil.)) in points. From the difference relative to the Free acid (FA) it is possible to determine the amount of complex fluoride. If this difference is multiplied by a factor of 0.36, the result is the amount of complex fluoride as $SiF_6^{2-}$ in g/l.

Total Acid, Fischer (TAF):

Following determination of the free acid (diluted), the dilute phosphating composition, following addition of potassium oxalate solution, is titrated, using a pH meter and an electrode, with 0.1 M NaOH to a pH of 8.9. The consumption of 0.1 M NaOH in this procedure, in ml per 10 ml of the dilute phosphating composition, gives the Total acid, Fischer (TAF) in points. If this figure is multiplied by 0.71, the result is the total amount of phosphate ions, calculated as $P_2O_5$ (see W. Rausch: "Die Phosphatierung von Metallen". Eugen G. Leuze-Verlag 2005, 3rd edition, pp. 332 ff).

Total Acid (TA):

The Total acid (TA) is the sum of the divalent cations present and also free and bonded phosphoric acids (the latter being phosphates). It is determined by the consumption of 0.1 M NaOH, using a pH meter and an electrode. For this purpose, 10 ml of the phosphating composition are pipetted into a suitable vessel, such as a 300 ml Erlenmeyer flask, and diluted with 25 ml of DI water. This is followed by titration with 0.1 M NaOH to a pH of 9. The consumption during this procedure, in ml per 10 ml of the dilute phosphating composition, corresponds to the points number of the Total acid (TA).

Acid Value (A Value):

The Acid value (A value) represents the ratio FA:TAF and is obtained by dividing the value for the Free acid (FA) by the value for the Total acid, Fischer (TAF).

The further improvement in the coating adhesion, especially on hot-dip galvanized surfaces, as a result of the setting of an acid value in the range from 0.03 to 0.065, more particularly in the range from 0.04 to 0.06, was surprising.

It has surprisingly emerged that, particularly in the case of steel or a hot-dip galvanized system as metallic surface, a phosphating composition temperature of less than 45° C., preferably in the range between 35 and 45° C., leads to further-improved corrosion and coating adhesion values.

The phosphating composition is substantially nickel-free. It contains preferably less than 0.1 g/l and more preferably less than 0.01 g/l of nickel ions.

As a result of the content of iron(III) ions, the substantially nickel-free phosphating composition, even after the repeated throughput of metallic substrates, has a significantly smaller amount of sludge. Its parameters remain stable.

The addition of iron(III) ions to the phosphating composition additionally contributes to comparable or virtually comparable electrochemical properties of essentially nickel-free phosphating metal surfaces which have been treated with nickel-containing phosphating solutions.

The addition of iron(III) ions to the phosphating composition, especially on steel, galvanized steel and aluminum, leads to a distinct improvement in the paint adhesion and anticorrosion results.

In the accompanying scanning electron micrographs, it can be seen that the phosphate layers formed are more continuous and finely crystalline as a result of use of Fe(III) (cf. in each case FIGS. 1 to 9). If the Fe(III) is not added, "etch holes" are apparent, which are attributable to a long etching attack and non-concluded layer formation.

In one embodiment, however, the phosphating composition is a conventional trication composition, meaning that it contains not only zinc ions and manganese ions but also at least 0.3 g/l, preferably at least 0.5 g/l and especially preferably at least 0.8 g/l of nickel ions. In the case of trication phosphating too—as already elucidated further up—a distinct rise in bath stability and additionally an improvement in the paint adhesion and anticorrosion results on aluminum are surprisingly found.

The metallic surface is treated with the phosphating composition for preferably 30 to 480 seconds, more preferably for 60 to 300 seconds, and very preferably for 90 to 240 seconds, preferably by means of dipping or spraying.

The treatment of the metallic surface with the phosphating composition produces the following preferred and particularly preferred zinc phosphate coat weights on the metallic surface, depending on the surface treated (determined by XRF, i.e. x-ray fluorescence analysis):

| Surface treated | Zinc phosphate coat weight ($g/m^2$) | |
|---|---|---|
| Steel | 0.5 to 6 | 1 to 5 |
| Hot-dip galvanized system | 1.0 to 6 | 1.5 to 5 |
| Electrolytically galvanized system | 1.0 to 6 | 1.5 to 5 |
| Aluminum | 0.5 to 6 | 1 to 5 |

The metallic surface already treated with the phosphating composition, i.e., already phosphate-coated, is preferably optionally rinsed and/or dried, but not treated thereafter with an aqueous after-rinse composition, especially not with one that comprises at least one type of metal ions and/or at least one polymer.

In a particularly preferred embodiment, the metallic surface already treated with the essentially nickel-free phosphating composition, i.e. phosphate-coated, is optionally rinsed and/or dried, but not treated thereafter with an aqueous after-rinse composition, especially not with one that comprises at least one kind of metal ions and/or at least one polymer.

This is because it has been found that, surprisingly, the addition of iron(III) ions to the essentially nickel-free phosphating composition, even without the use of an after-rinse solution, can achieve good results with regard to paint adhesion and an improvement with regard to corrosion protection.

The invention further relates to a phosphate-coated metallic surface which is obtainable by the process of the invention.

Then, cathodically, an electrocoat material may be deposited on the phosphate-coated metallic surface, and a coating system applied.

The metallic surface in this case is optionally first rinsed, preferably with deionized water, and optionally dried.

In the text below, the intention is to illustrate the present invention by means of working examples, which should not be understood as imposing any restriction, and comparative examples.

Comparative Examples 1 to 3

Test plates made of hot dip galvanized steel (EA), electrolytically galvanized steel (G) or aluminum (AA6014S) were coated by means of a nickel-free phosphating solution at 45° C. containing 1.3 g/l of Zn, 1 g/l of Mn and 13 g/l of $PO_4^{3-}$ (calculated as $P_2O_5$).

Examples 1 to 3

Test plates made of hot dip galvanized steel (EA), electrolytically galvanized steel (G) or aluminum (AA6014S) were coated by means of a nickel-free phosphating solution at 45° C. containing 1.3 g/l of Zn, 1 g/l of Mn, 13 mg/l of Fe(III) and 13 g/l $PO_4^{3-}$ (calculated as $P_2O_5$).

Comparative Examples 4 to 6

Test plates made of hot dip galvanized steel (EA), electrolytically galvanized steel (G) or aluminum (AA6014S) were coated by means of a phosphating solution at 53° C. containing 1.3 g/l of Zn, 1 g/l of Mn, 14 g/l of $PO_4^{3-}$ (calculated as $P_2O_5$), 3 g/l of $NO_3^-$ and additionally 1 g/l of nickel.

After phosphating had taken place, test plates according to comparative examples 1 to 6 (CE1 to CE6) and examples 1 to 3 (E1 to E3) were examined with a scanning electron microscope (SEM).

The resultant images are shown in FIGS. 1 to 9.

FIG. 1: CE1, test plate: EA

Figure 2:
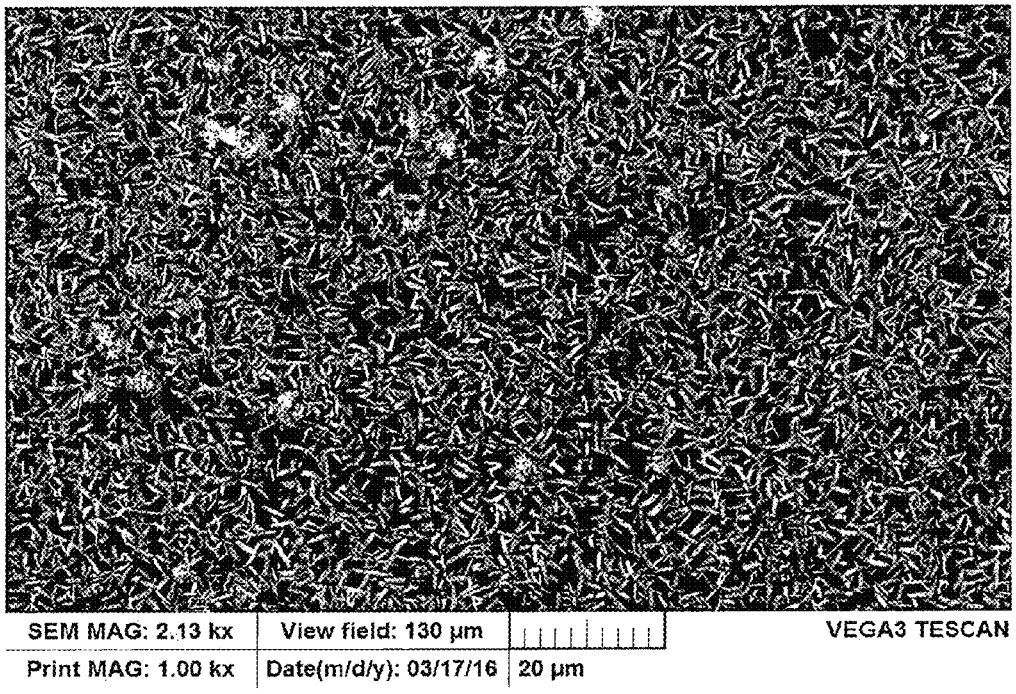
FIG. 2 depicts a scanning electron micrograph of an exemplary phosphate layer prepared on a hot dip galvanized steel test plate according to a first example.

FIG. 2: E1, test plate: EA

Figure 3:
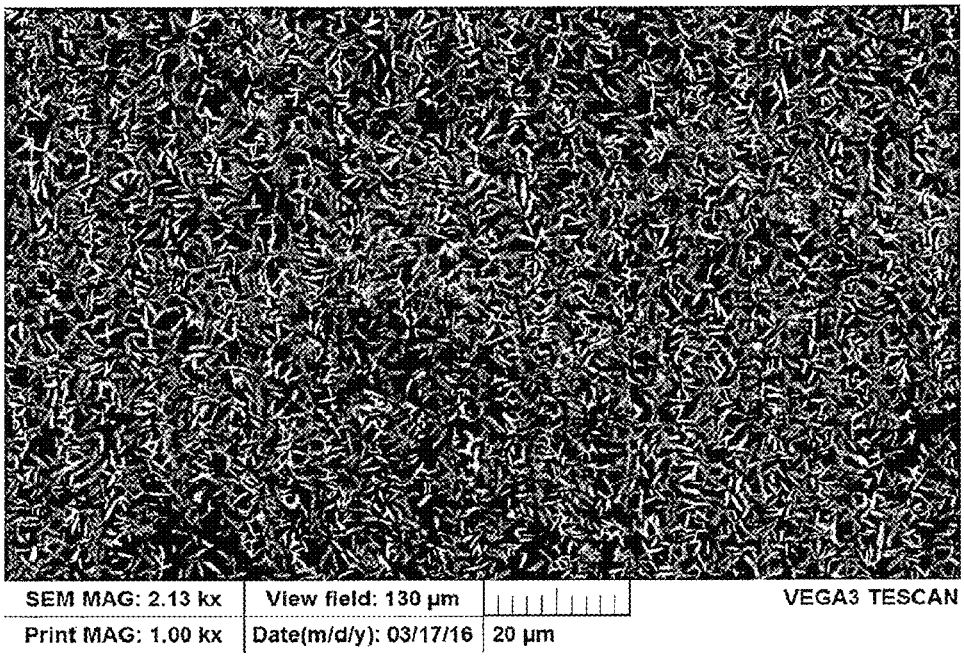
FIG. 3 depicts a scanning electron micrograph of an exemplary phosphate layer prepared on a hot dip galvanized steel test plate according to a fourth comparative example.

FIG. 3: CE4, test plate: EA

Figure 4:
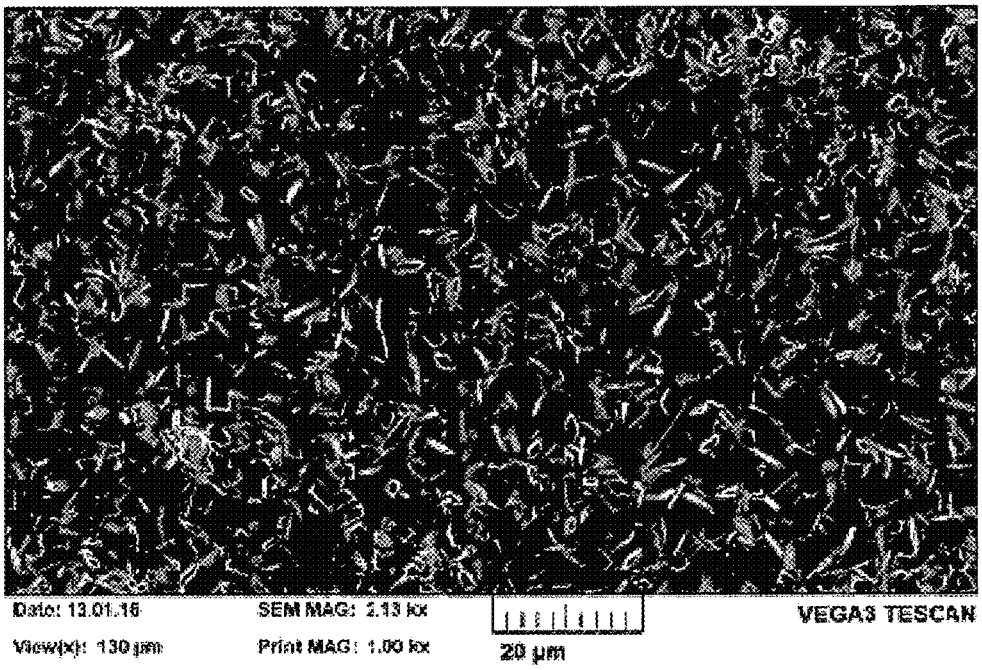
FIG. 4 depicts a scanning electron micrograph of an exemplary phosphate layer prepared on an electrolytically galvanized steel test plate according to a second comparative example.

FIG. 4: CE2, test plate: G

Figure 5:
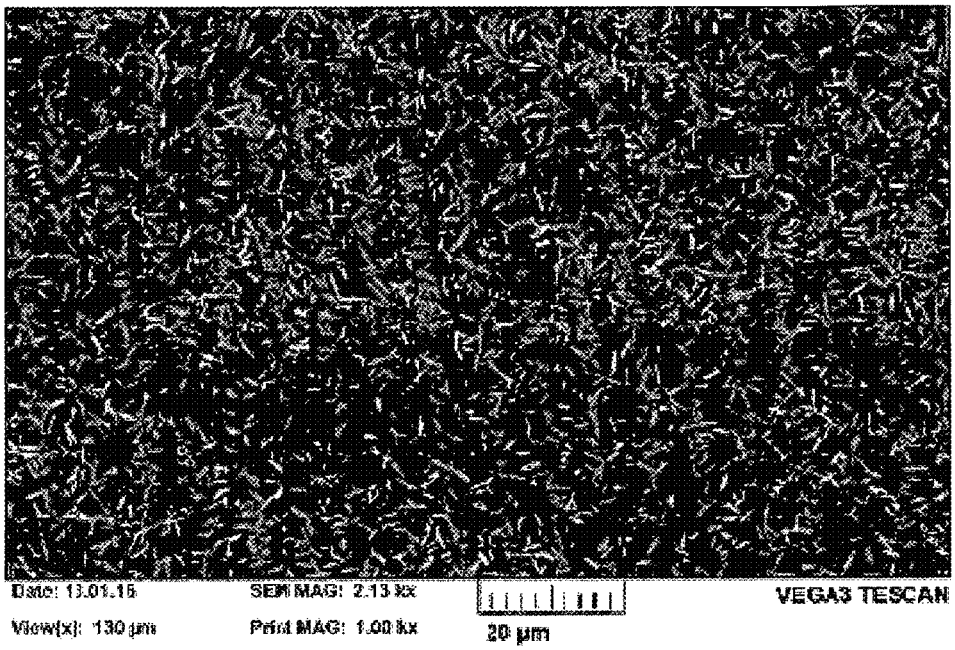
FIG. 5 depicts a scanning electron micrograph of an exemplary phosphate layer prepared on an electrolytically galvanized steel test plate according to a second example.

FIG. 5: E2, test plate: G

Figure 6:
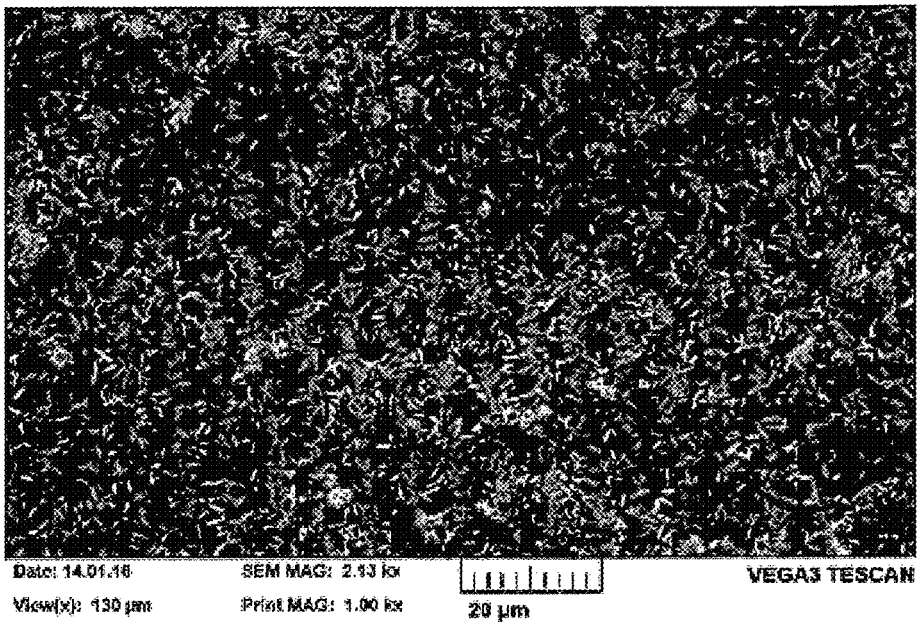
FIG. 6 depicts a scanning electron micrograph of an exemplary phosphate layer prepared on an electrolytically galvanized steel test plate according to a fifth comparative example.

FIG. 6: CE5, test plate: G

Figure 7:
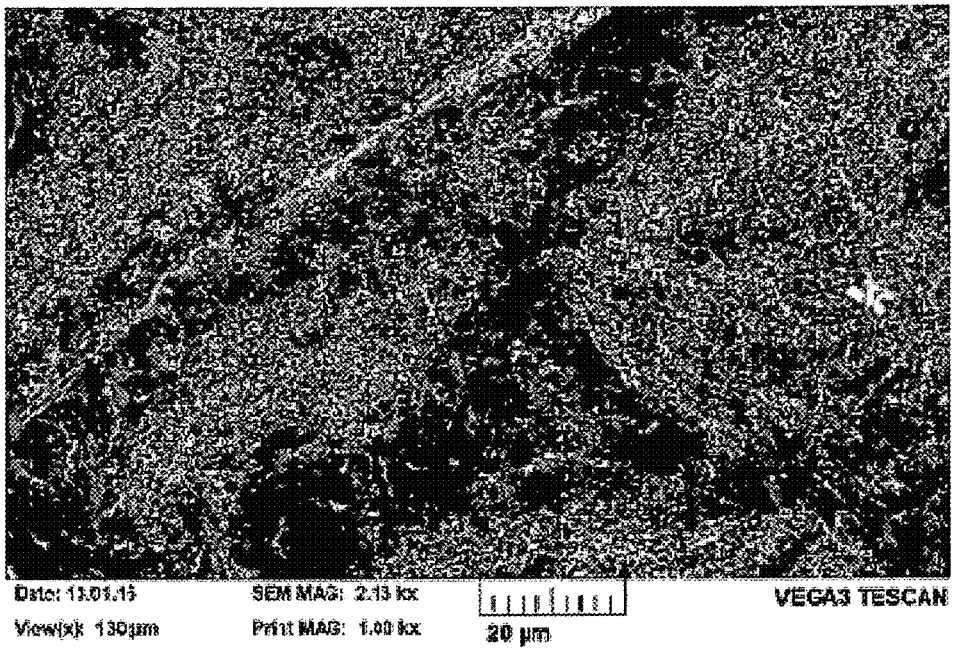
FIG. 7 depicts a scanning electron micrograph of an exemplary phosphate layer prepared on an aluminum test plate according to a third comparative example.

FIG. 7: CE3, test plate: AA6014S

Figure 8:
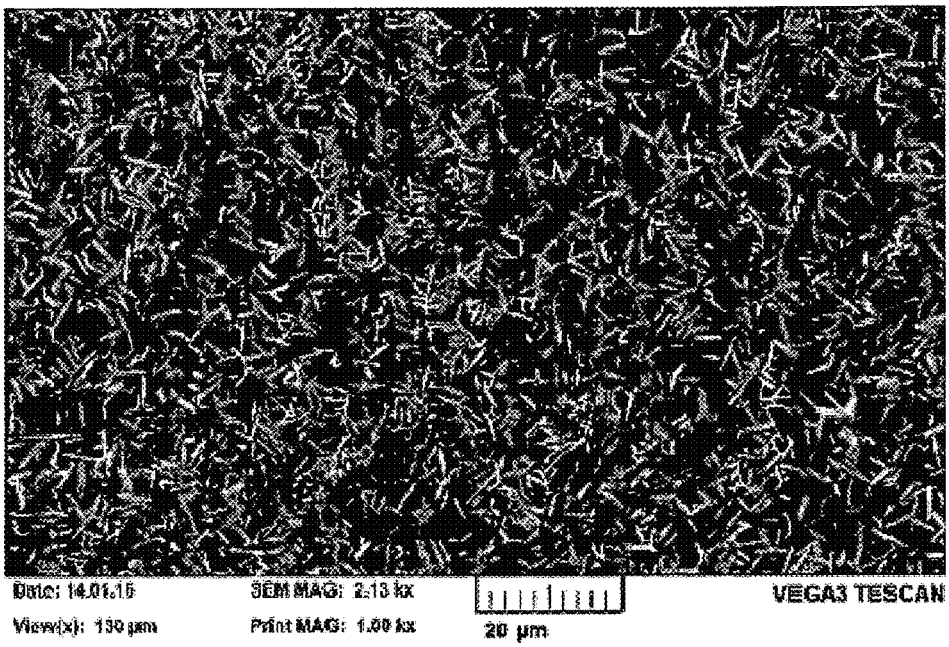
FIG. 8 depicts a scanning electron micrograph of an exemplary phosphate layer prepared on an aluminum test plate according to a third example.

FIG. 8: E3, test plate: AA6014S

Figure 9:
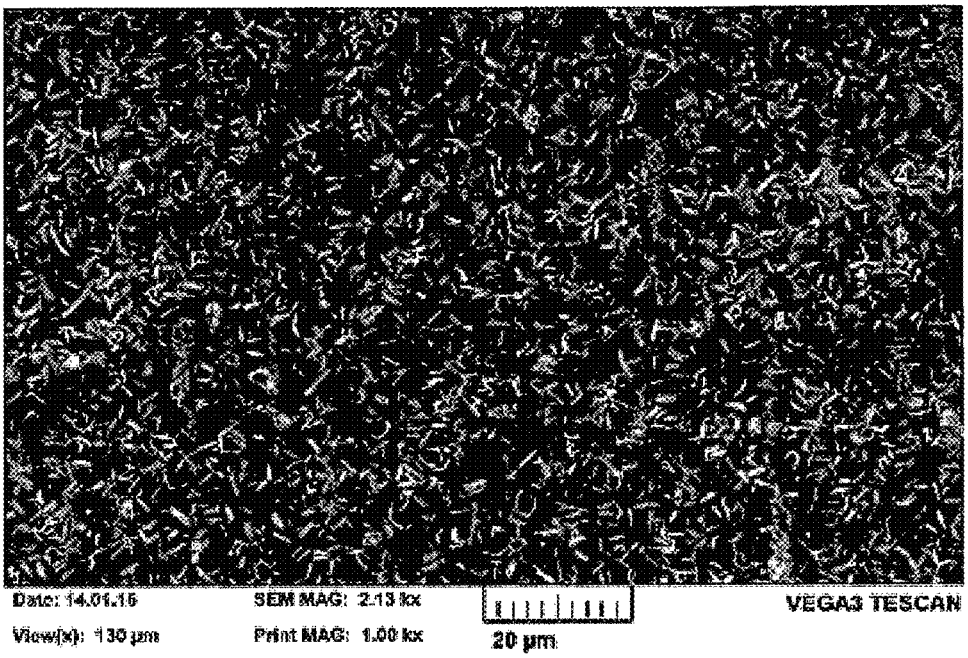
FIG. 9 depicts a scanning electron micrograph of an exemplary phosphate layer prepared on an aluminum test plate according to a sixth comparative example.

FIG. 9: CE6, test plate: AA6014S

On EA and G, the phosphate layers are incomplete and uneven without addition of Fe(III) (cf. FIGS. 1 and 4). Significant etching attack has resulted in circular holes (called etch holes). This is attributable to the fact that layer formation is not quick enough and hence permanent etching has taken place. On AA6014S, no phosphate layer at all is detectable (cf. FIG. 7). The surfaces of the test plates are black as a result of the deposition of elemental zinc. The phosphate layers become finer as a result of addition of Fe(III) (cf. FIGS. 2, 5 and 8)—comparable with the layer obtained by nickel-containing phosphation in each case (cf. FIG. 3, 6 or 9).

After phosphating had taken place, all the test plates were additionally coated with a cathodic electrocoat material and also with a standard automotive coating system (filler, basecoat, clearcoat) and then subjected to a DIN EN ISO 2409 cross-cut test. Tested in each case were 3 plates, before and after exposure for 240 hours to condensation water (DIN EN ISO 6270-2 CH). The corresponding results are found in Tab. 1. In these results, a cross-cut outcome of 0 is the best, one of 5 the poorest result. Results of 0 and 1 here are of comparable quality.

TABLE 1

| (Comparative) Example | Test plate | Cross-cut before exposure (0-5) | Cross-cut after exposure (0-5) |
|---|---|---|---|
| CE1 | EA | 1/1/1 | 3/5/4 |
| E1 | | 1/1/1 | 1/1/2 |
| CE4 | | 0/0/1 | 1/1/1 |
| CE2 | G | 1/1/1 | 5/5/5 |
| E2 | | 0/0/1 | 1/0/1 |
| CE5 | | 1/1/1 | 1/1/1 |
| CE3 | AA6014S | 1/1/1 | 5/5/5 |
| E3 | | 1/1/1 | 1/1/1 |
| CE6 | | 0/0/0 | 0/0/0 |

Tab. 1 shows the poor results of CE1, CE2 and CE3 (nickel-free, without Fe(III)) after exposure, whereas E1, E2 and E3 (nickel-free, with Fe(III)) afford results which are good, and are comparable to CE4, CE5 and CE6.

In addition, the test plates of comparative examples 3 and 6 (CE3 and CE6) and of example 3 (E3) were subjected to a Filiform test (with HCl) according to DIN EN 3665 (in the 1997 version). This involves determining the damage after 504 hours analogously to the median corrosive undermining according to DIN EN ISO 4628-8 (in the 2013 version) or LPV 4 (in the 2012 version).

TABLE 2

| (Comparative) Example | Test plate | Filiform median | Filiform max |
|---|---|---|---|
| CE3 | AA6014S | 10/9/10 | 17/17/19 |
| E3 | | 2.5/2.5/2 | 5/8/6.5 |
| CE6 | | 0.5/0.8/0.8 | 2.5/3/3.5 |

Tab. 2 shows the distinct reduction in filiform corrosion achieved through addition of Fe(III) (E3 versus CE3).

After phosphating had taken place, test plates as per comparative examples 1, 2, 4 and 5 (CE1, CE2, CE4 and CE5) and also examples 1 and 2 (E1 and E2) were additionally subjected to a VDA test (VDA 621-415), which determined the coating undermining (U) in mm and also—in the case of E1, CE1 and CE4—the coating detachment after stone chipping (DIN EN ISO 20567-1, Method C). A result of 0 is the best here, a result of 5 poorest. A figure up to 1.5 is considered good. The results are likewise summarized in Tab. 3.

The test plates of comparative examples 3 and 6 (CE3 and CE6) and also of example 3 (E3), in contrast, were subjected to a 240-hour CASS test in accordance with DIN EN ISO 9227. The results are summarized in Tab. 4.

TABLE 3

| (Comparative) Example | Test plate | VDA U in mm | VDA Stone chipping |
|---|---|---|---|
| CE1 | EA | 0.8/1.5/1.3 | 1.5/1/1.5 |
| E1 | | 0.3/0.5/0.8 | 1/1/0.5 |
| CE4 | | 0.3/0.3/0.3 | 0.5/0.5/0.5 |
| CE2 | G | 3/2.5/2.3 | n.d. |
| E2 | | 1.3/1.5/1.5 | n.d. |
| CE5 | | 0.8/0.8/1 | n.d. |

TABLE 4

| (Comparative) Example | Test plate | CASS |
|---|---|---|
| CE3 | AA6014S | 3.5/4/3.5 |
| E3 | | 2/1.8/1.8 |
| CE6 | | 0.5/0.5/0.5 |

For the purpose of studying the effect of the addition of Fe(III) on bath stability, firstly a nickel-free phosphating bath without addition of Fe(III) (CE7) and secondly one with addition of Fe(III) (E4) were made up.

Comparative Example 7

The bath without addition of iron was initially sludge-free. The bath values were: FA (KCl)=1.3 and Zn content=1.2 g/l.

However, after the throughput of a few sheets of different substrates, the bath became turbid. Steel became gradually rusty; aluminum turned darker. The appearance of the deposited phosphate layer became less uniform.

As a result of the precipitation of zinc salts, there was distinct sludge formation only a short time later. The Zn content fell to 1.0 g/l, and so it was necessary to add zinc in the form of zinc phosphate.

At the end of the experiment, incrustations, some of them severe, were found on the bath wall.

In addition, the coat weight of the deposited phosphate layers was determined by means of XRF analysis. It was found here that, in a bath without addition of Fe(III), there was sometimes significant variation in the coat weights (cf. tab. 5 below, wherein the numbering of the sheets corresponds to the sequence of treatment):

TABLE 5

| Sheet sequence | CW in $g/m^2$ |
|---|---|
| Sheet 1 | 2.4 |
| Sheet 2 | 2.3 |
| Sheet 3 | 1.9 |
| Sheet 4 | 2 |
| Sheet 5 | 2.1 |
| Sheet 6 | 2 |
| Sheet 7 | 1.9 |

It can be seen that the coat weight was at first relatively high, fell with rising sheet throughput and then varied.

Example 4

10 mg/l of Fe(III) were added to the other nickel-free bath. Subsequently, the FA (KCl) was adjusted to about 1.3. There was no change in the Zn content, and it remained stable at 1.3 g/l.

Even on the last day, there was no change in the latter and it was stable. The same was true of the FA (KCl). Compared to the bath without addition of Fe(III), distinctly less sludge was formed. With the throughput of sheets, the amount of the sludge did not increase significantly either, and the FA (KCl) (1.3) and the Zn content (1.3 g/l) remained constant.

The invention claimed is:

1. A method for phosphating of a metallic surface, comprising optionally cleaning and/or activating the metallic surface, treating the metallic surface with an acidic, aqueous, substantially nickel-free phosphating composition which comprises zinc ions, manganese ions, iron(III) ions and phosphate ions, and optionally rinsing and/or drying the treated metallic surface wherein the phosphating composition has a Free acid value in the range from 0.3 to 2.0, a Free acid (diluted) value in the range from 0.5 to 8, a Total acid, Fischer value in the range from 12 to 28, a Total acid value in the range from 12 to 45, and an Acid value in the range from 0.03 to 0.065.

2. The method according to claim 1, wherein the metallic surface is at least partly galvanized.

3. The method according to claim 1, wherein the content of iron(III) ions in the phosphating composition is in the range from 1 to 200 mg/l.

4. The method according to claim 3, wherein the content of iron(III) ions in the phosphating composition is in the range from 5 to 100 mg/l.

5. The method according to claim 4, wherein the content of iron(III) ions in the phosphating composition is in the range from 5 to 20 mg/l.

6. The method according to claim 1, wherein the phosphating composition comprises 0.3 to 3.0 g/l of zinc ions, 0.3 to 2.0 g/l of manganese ions, and 8 to 25 g/l of phosphate ions (calculated as $P_2O_5$).

7. The method according to claim 1, wherein the phosphating composition comprises 30 to 250 mg/l of free fluoride.

8. The method according to claim 1, wherein the phosphating composition comprises 0.5 to 3 g/l of complex fluoride.

9. The method according to claim 8, wherein the complex fluoride is tetrafluoroborate ($BF_4^-$) and/or hexafluorosilicate ($SiF_6^{2-}$).

10. The method according to claim 1, wherein the phosphating composition comprises $H_2O_2$ as accelerator.

11. The method according to claim 1, wherein the phosphating composition contains less than 1 g/l of nitrate.

12. The method according to claim 11, wherein the phosphating composition contains less than 0.1 g/l of nitrate.

13. The method according to claim 12, wherein the phosphating composition contains from 0.05 to 0.1 g/l of nitrate.

14. The method according to claim 1, wherein the iron(III) ions are added to the phosphating composition prior to the establishment of the Free Acid.

15. The method according to claim 1, wherein the metallic surface already treated with the phosphating composition is optionally rinsed and/or dried, but not treated thereafter with an aqueous after-rinse composition.

16. An acidic, aqueous, substantially nickel-free phosphating composition for phosphating of a metallic surface according to claim 1.

17. A concentrate from which a phosphating composition according to claim 16 is obtainable by dilution with a suitable solvent by a factor of between 1 and 100 and, where necessary, addition of a pH-modifying substance.

* * * * *